United States Patent [19]

Cislo

[11] Patent Number: 4,890,466

[45] **Date of Patent: * Jan. 2, 1990**

[54] LOCKBOX AND CARRYING CASE FOR PISTOLS

[76] Inventor: Daniel M. Cislo, 3413 Rambla Pacifico, Malibu, Calif. 90265

[ * ] Notice: The portion of the term of this patent subsequent to Dec. 6, 2005 has been disclaimed.

[21] Appl. No.: 253,581

[22] Filed: Oct. 5, 1988

Related U.S. Application Data

[63] Continuation-in-part of Ser. No. 19,518, Jul. 18, 1988, Pat. No. 4,788,838.

[51] Int. Cl.[4] ..... E05B 65/52

[52] U.S. Cl. ..... 70/63; 109/51

[58] Field of Search ..... 70/63, 69, 67; 109/51, 109/68; 312/209, 204; 5/503, 507, 508

[56] References Cited

U.S. PATENT DOCUMENTS

| | | | |
|---|---|---|---|
| 4,155,608 | 5/1979 | Orlewicz | 109/51 |
| 4,348,967 | 9/1982 | Schattner | 109/51 |
| 4,663,621 | 5/1987 | Field | 312/209 |
| 4,768,021 | 8/1988 | Ferraro | 70/63 |
| 4,788,838 | 12/1988 | Cislo | 70/63 |
| 4,807,315 | 2/1989 | Wachenheim | 109/68 |

*Primary Examiner*—Robert L. Wolfe

[57] ABSTRACT

An improved apparatus to lock a handgun within a compartment while the compartment is readily lockable to a stationary object using a detachable bracket. The compartment is only accessible by authorized persons selecting a particular code which unlocks a latch to open the compartment. The bracket can only be detached when the apparatus is in an open position. The latch can be lighted to allow the selecting of the proper code in darkness. The apparatus also serves to carry the handgun and can be subsequently used to so secure the handgun at another location.

20 Claims, 2 Drawing Sheets

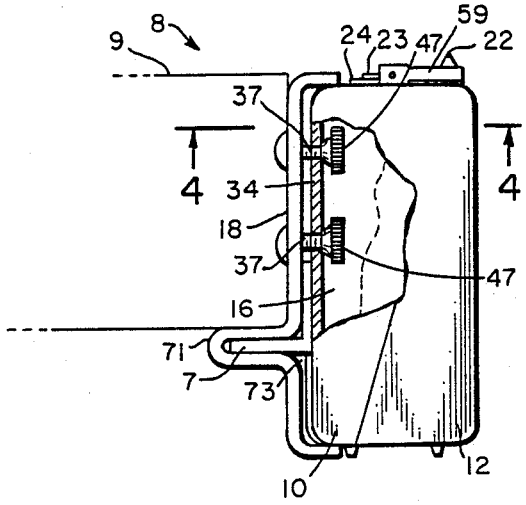
Fig. 2.
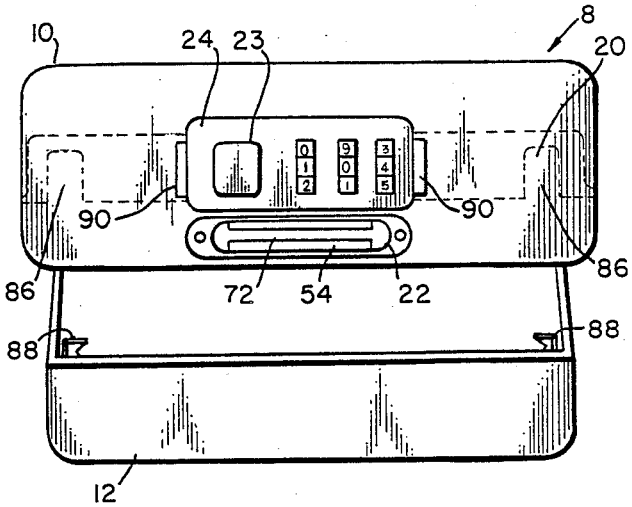
Fig. 3.
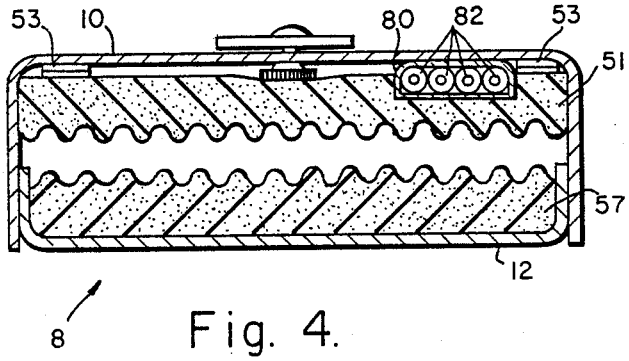
Fig. 4.
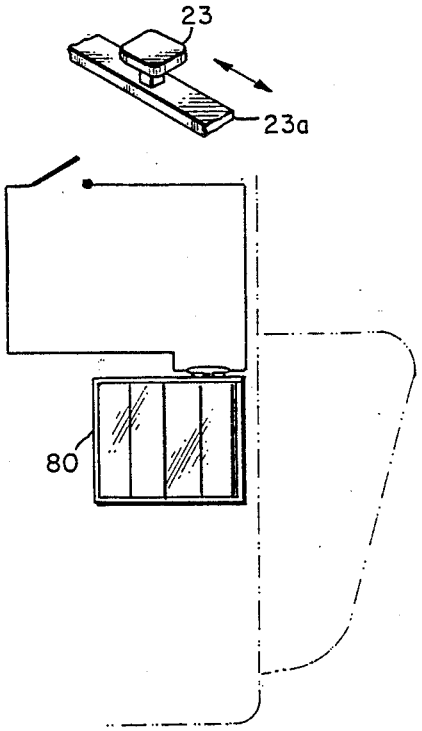
Fig. 5.
Fig. 6.
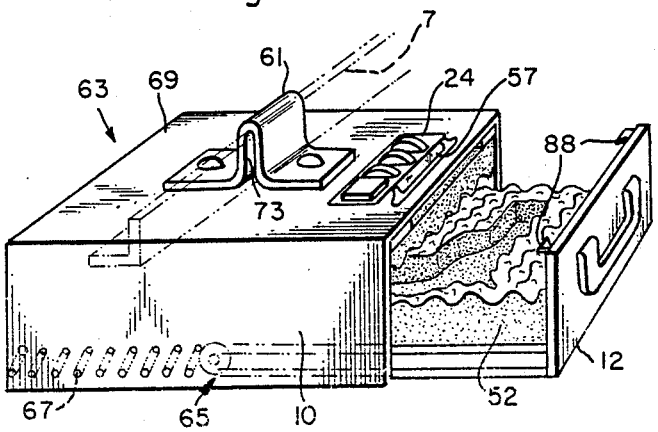

LOCKBOX AND CARRYING CASE FOR PISTOLS

This application is a continuation-in-part application of an earlier filed patent application entitled GUARDIAN LOCK BOX FOR PISTOLS, application Ser. No. 07/019,518 allowed on July 18, 1988 and now U.S. Pat. No. 4,788,838.

BACKGROUND OF THE INVENTION

This invention relates generally to improved handgun safety mechanisms, and, more particularly, to a handgun lockbox and case for securely storing and carrying a handgun while still making it accessible.

Handgun safety mechanisms vary in type, complexity, and effectiveness. Such mechanisms typically comprise locking means which fit around the trigger guard of a handgun. The locking means prevents access to the trigger and locks the trigger in a set position relative to the handgun's trigger guard. For many guns, this effectively prevents the trigger and hence the hammer or firing means from moving. This prevents accidental firing of the weapon when the mechanism is properly used. However, other handguns have firing pins or hammers which if jarred can accidentally fire the weapon in the event it is loaded. Therefore, use of these locking mechanisms for safely storing a handgun is only advisable if the gun is unloaded. Additionally, those safety devices do not prevent the handgun from being carried away, nor protect the handgun from nicks and scratches.

Locking cases or strongboxes are other alternatives gun owners have available. These options have mechanisms which are locked and unlocked by the use of a key which must be available to access the gun. Usually the key is located in a different area for security reasons.

In the event an intruder disturbs the slumber of a handgun owner at night, the handgun so protected is of little use. The owner would have to locate the key to the locking mechanism, unlock the locking mechanism (by fumbling around in the dark or turning on a light), load the pistol with ammunition that is probably likewise in a different location, and only then confront the intruder. Even if a type of combination lock were used, the handgun owner would have to use an independent source of light to access the lockbox. Additionally, the lockbox can be easily carried away and subsequently opened.

Also, typical gun lockboxes do not have the flexibility of also being used for a carrying case. A larger safe or strongbox cannot be carried with its owner and used while traveling.

There is substantial interest to millions of handgun owners to not only safely and securely store their handguns, but also have them loaded and readily accessible in the event of an intruder, especially at night. Furthermore, the added utility of being able to safely transport the handgun and use a securing feature while traveling is of great interest.

The features identified above as being desirable for a handgun safety device are all provided by the present invention.

SUMMARY OF THE INVENTION

The present invention is embodied in an improved handgun lockbox that can safely and securely store a loaded handgun of a variety of sizes, yet make it readily accessible in the dark of the night. The invention is extremely economical, completely effective in securing a handgun, serves as a carrying case, prevents gun theft and can only be opened by someone with knowledge of a predetermined code. The code may be easily selected at night by a lighted display which may be activated by touch. Also, the invention can be used to safely transport the handgun, as well as serve its full protective function at a new location when traveling.

More particularly, the lockbox has a fastener or fasteners which allow it to be locked to any number of standard bed frame supports. This makes the lockbox literally inches away and seconds from use for anyone sleeping in the bed supported by the bed frame. The person in bed need only reach over and activate the lighting means of the lockbox which illuminates an access code pad allowing a code to be selected. Once the code is selected, a latch means can be unlocked which causes the lockbox to "pop open" exposing a consistently oriented and loaded pistol ready for use. By removing the fastener, the lockbox can be used to securely transport the handgun within, using a handle associated with the lockbox.

In more detailed aspects of the embodiment of the invention, the surrounding compartment of the lockbox is made up of two wedge shaped housings forming the lockbox. The handgun is put in the lockbox such that the weight of the handgun contained within causes the first housing to swing open when the lockbox is unlocked. The second housing remains attachably and securely fastened to an ordinary bed frame support. Fastening is achieved by a detachable bracket which conforms to the shape of a variety of different bed frame supports. This allows the bed frame support to be firmly grasped between the bracket and the second housing while allowing a mattress to be placed over the bracket and the bed frame. This configuration effectively prevents anyone from taking the lockbox and the enclosed handgun. The bracket can be easily and quickly detached from the lockbox when the lockbox is in an open position. In the invention's transport mode, the bracket may also be carried within the lockbox.

In another embodiment of the present invention, a similar bracket is used to fasten the lockbox in a position, completely under the bed. The lockbox comprises an outer and inner portion. The inner portion slideably moves away from the outer portion when a latching means is actuated. Similarly, an illuminated access panel is readily exposed which allows the latching means to be activated in complete darkness.

BRIEF DESCRIPTION OF THE DRAWINGS

FIG. 2 is a side plan view of the present handgun lockbox of the present invention in a closed position, in partial crossection, and attached to a standard bed frame, partially showing a handgun in phantom line;

FIG. 3 is a top plan view of the handgun lockbox of the present invention, partially open with a portion of the latching means shown in phantom line;

FIG. 4 is a top crossectional view of the handgun lockbox of the present invention, taken along line 4—4 of FIG. 2;

FIG. 5 is a schematic view of the relationship between the latching mechanism and the lighting circuit to light the access code panel, and a portion of a first housing shown in phantom line; and FIG. 6 is a perspective view of another embodiment of the present invention in an open position and a portion of a bed frame support in phantom line.

DESCRIPTION OF THE PREFERRED EMBODIMENTS

Figure 1:
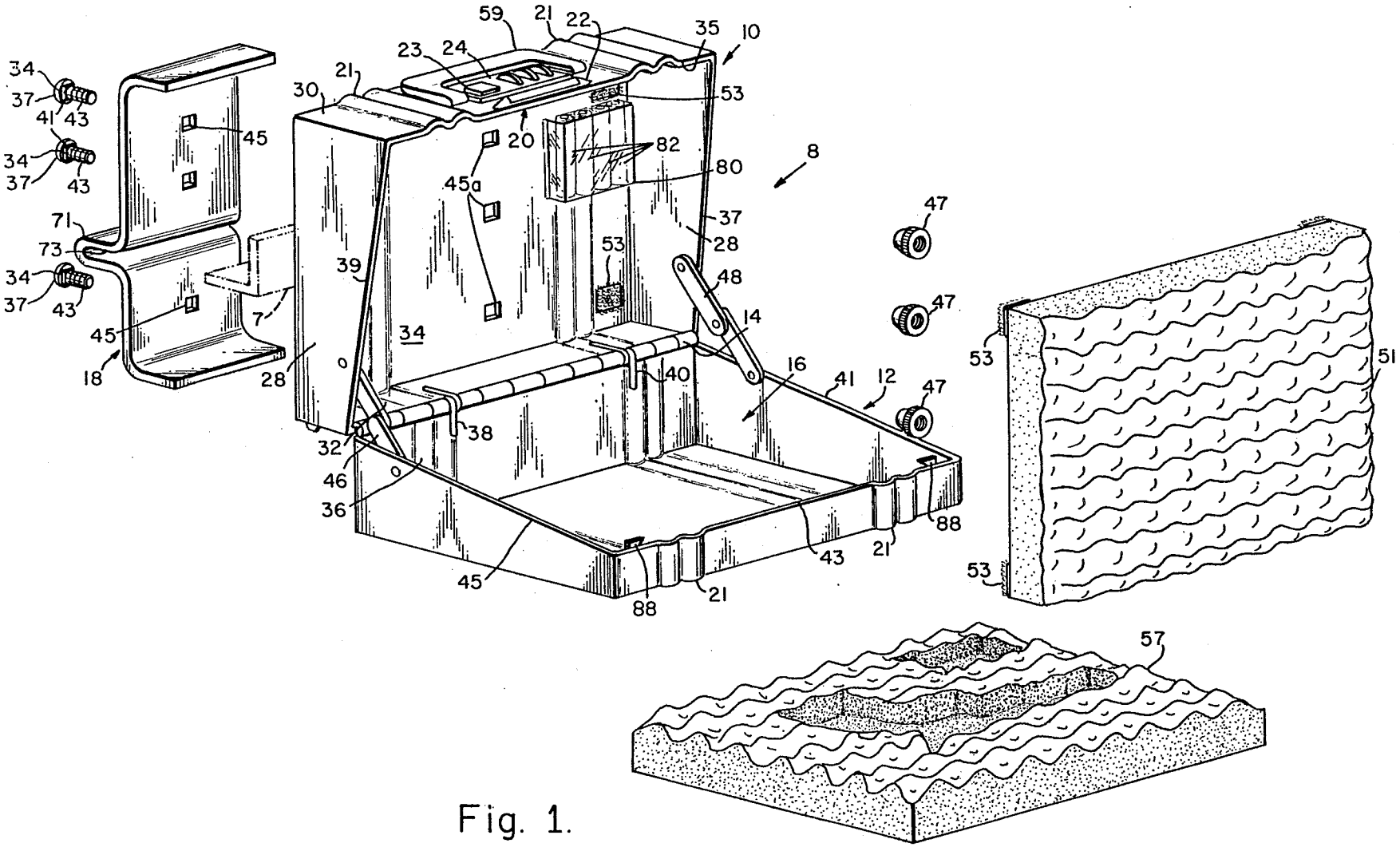
FIG. 1 is an exploded perspective view of the handgun lockbox of the present invention, showing one of the different types of brackets which can be used, and a bed frame support partially shown in phantom line.

Incorporated by reference herein is the disclosure contained in the previously mentioned and allowed application No. 7/019,518, entitled GUARDIAN LOCKBOX FOR PISTOLS, allowed July 8, 1988 and now U.S. Pat. No. 4,788,838.

Referring to the drawings wherein like numerals of reference describe like elements throughout and as shown in FIG. 1, the invention is embodied in a lockbox 8 of a kind that can be locked onto a standard bed frame support 7 shown in phantom line to safely hold a handgun in close proximity to one lying on a bed as shown in the referred to application.

As shown in FIGS. 1 and 2 of the present application, the lockbox 8 includes two almost wedge-shaped complementary housings 10 and 12. A first housing 10 and a second housing 12 is joined by a coupling or hinge means 14 so as to come together and form a compartment 16 within the interior of housings 10 and 12. The lockbox 8 also includes a bracket 18, which releaseably fastens to the first housing 10 to lock the lockbox 8 to the bed frame support 7. A box spring 9 or mattress can be placed over the bed frame support 7.

The housings 10 and 12 are locked together in a closed position by a latching means 20 which can only be operated by the user of the invention knowing a preselected, specific access code. A light means 22 can be activated by touch to illuminate an access code panel 24 where the access code is to be inputed. In FIG. 3, a top view of the latching means 20, access code panel 24 and lighting means 22 is illustrated.

Preferably, the latching means 20 and lighting means 22 are electronically and/or mechanically integrated so that a lighting means actuator button or lever 23 actuates the lighting means 22, and subsequently upon further movement opens the latching means 20 once the proper code has been inputed or dialed. Such a possible integration is shown by the schematic in FIG. 5.

A battery housing 80 preferably of plastic retains four AAA sized batteries 82. The battery housing 80 is fixedly attached by glue or rivets to the inside of the first housing 10 while wires 84 run along the interior of the second housing 10 to an area beneath the access code panel 24. At the access code panel 24, a circuit may be completed creating a lighting condition.

The lighting-latching function can be accomplished using the actuator button 23 which is connected to an actuation bar 23*a* which moves in two directions shown by arrows in FIG. 5. The actuator bar 23*a* can move its fully allowable distance when the access code is input allowing such movement as possible by many mechanisms known in the latching art. As shown in FIG. 3, movement in one direction locks or opens two side catches 86 which can receivably hold or release tongues 88 located on the opposite and adjacent edge of the second housing 12. One catch and one tongue centrally located may be sufficient in other embodiments. An intermediate position of the actuator button 23 closes the electrical circuit shown in FIG. 5, but does not release side catches 86. Therefore, even though the proper access code has not been entered on the access code panel 24, the activator button 23, and actuator bar 23*a* can move a limited distance, closing the circuit and illuminating the access code panel 24. The lighting means 22 may thus serve as a night light without actually opening the lockbox 8.

In accordance with the invention, as best seen in FIG. 1, the first housing 10 comprises five panels: four sides and a bottom. Two sides 26 and 28 of first housing 10 have a somewhat trapezoidal shape with rounded corners while the other two sides 30 and 32 have a rectangular shape with rounded corners. The first rectangular side 30 is wider than the second rectangular side 32 while the bottom 34 is rectangular having the greatest area of all the panels. The panels making up the sides 26, 28, 30 and 32 and bottom 34 are at right angles to their adjacent panels and are sufficiently large so when assembled together form half of a compartment in which a handgun will fit.

For more secure construction, the second housing 12 may be constructed of a slightly smaller size so that the second housing 12 may partially fit within the first housing 10. This construction helps prevent the two housings 10 and 12 from being pried apart.

The panels 26, 28, 30, 32 and 34 are made of a strong durable material, preferably sheet metal, hard plastic, or made of some other material of sufficient strength and so fastened together to prohibit breaking under extreme force. Specific areas of the panels may be made thicker or have additional reinforcement members, not shown, of varying materials at points most likely to encounter greater stress.

The edges where the panels 26, 28, 30, 32 and 34 come together are rounded for style and for safety. Rounded corners are less likely to cause injury in the event one accidentally bumped into the installed lockbox 8.

The second housing 12 is of similar construction and material. The hinge means 14 joins the first housing 10 along its smaller rectangular side 32 and the second housing 12 along its larger rectangular side 36. The housings can rotate with respect to each other around the hinge means 14 to bring the exposed edges of all panels not in contact with complementary panels of both housings together.

When edges 35, 37 and 39 of the first housing 10 are in contact or overlapping proximity with the complementing edges 41, 43 and 45 of the second housing 12, the interior compartment 16 is formed of sufficient size to hold a handgun, not shown, within. In the preferred embodiment, the second housing 12 is of a size which allows the housing 12 to recess into the first housing 10, thereby making unauthorized access even more difficult.

The rectangular panels of both housings 10 and 12 may have ripples or protuberances 21. This gives the housings greater rigidity, styling, serve as feet for standing the lockbox 8 on end, and prevent the bracket 18 from being pryed away from the first housing 10 when in an installed condition as shown in FIG. 2.

When the lockbox 8 is in an upright position as shown in FIG. 2, the weight of the handgun on the second housing 12 causes the second housing 12 to rotate about the first housing 10 when the housings are not latched together. This effectively causes the lockbox 8 to "pop open" when the latching means 20 is unlocked. The "pop open" action may be accentuated by the use of tension springs 38 and 40. The tension springs 38 and 40 are held in position by the hinge means 14 commonly known in the art of tension springs. The two tension springs 38 and 40 are located along the hinge means 14 and exert force along the two panels 32 and 36 joined by the hinge means 14 pushing the two housings 10 and 12 apart.

In FIG. 2 the phantom lines of a handgun show the position of the handgun within the compartment 16 formed by both housings 10 and 12. Also, shown in FIG. 2 is the bracket 18 joined to the bottom side 34 of the first housing 10. The bracket 18 is removeably secured to the side 30 by three bolts 37 which have rounded heads 39, square shanks 41 and extending threading 43. In other embodiments one bolt may be sufficient. The rounded heads 39 insure that the bolts 37 are nonobtrusive when fastened to the bottom side 34. The square shanks 41 allow the bolts 37 to pass through square slots 45 in the bracket 18 and square slots **45*a* in the bottom side 34 of the first housing 10. The orientation of the slots 45 and 45*a* allow the bracket to be securely held to the bottom side 34 via the bolts 37. Enlarged nuts 47 with knurled surfaces 49 engage the threading 43 of the bolts 37**.

The bolts 37 are positively held in the square slots 45 and **45*a* by their square shank 41. The nuts 47 may be easily threaded onto the bolts 37 without having to hold the bolts 37 since their square shanks 41 are positively held in the square slots 45 and 45*a*. In use, the bracket 18 may be one of several types. One is shown in FIG. 1, and is positioned around the bed frame support 7 but may be removed from the bed frame support 7. The bracket 18 is of a contoured shape to allow it to come in contact with the bed frame support 7 touching and holding the support 7 between the bracket 18 and the first housing 10. The bracket 18 is bent at about its midsection 71 or three quarters down its length, such that it makes a right angle along its length, extends a distance which may vary depending upon the bracket used (depending upon the bed frame encountered), and makes another right angle along its length. A bite 73 created by the bracket's shape may be varied offering slightly different brackets 18** for different bed frames encountered.

To install the lockbox 8 to a bed frame, the first and second housings 10 and 12 are held in an open position. The bottom side 34 of first housing 10 is held flush against the bed frame support 7. A variety of different brackets may be chosen depending upon the bed frame support 7. Assuming the mattress and/or box springs 9 are taken off the bed frame, the bracket 18 can be fitted around the bed frame support 7 and engage the exposed side 34 of the first housing of the lockbox 8.

Foam padding 51 used within the first housing 10 is removed to expose the square slots 45 in the rectangular bottom 34. The bolts 37 are pushed through the square slots 45 of the bracket 18 and the square slots **45*a* of the rectangular bottom 34. The nuts 47 are securely threaded onto the bolts 37 from the inside of the first housing 10. The padding 51 can then be repositioned within the first housing 10. The padding 51 can be fixedly held using velcro fasteners 53 or the like for easy removal and subsequent replacement within the first housing 10**.

The first and second housings 10 and 12 may have two other mutually shared hinges 46 and 48 which attach to the opposing trapezoidal sides of each housing. The shared hinges 46 and 48 are comprised of metal tabs each joined together to rotate about a common area on one end and their other end joined to both housings about midway between the end of the housings trapezoidal sides. The design of these hinges 46 and 48 is commonly known in the art of hinge design. The shared hinges 46 and 48 prevent the second housing 12 from rotating about the hinge means 14 more than a predetermined degree. The predetermined degree is established so that the second housing 12 will be about perpendicular to the first housing 10 when the lockbox 8 is in its furthest most open position. Strings or flexible tabs, not shown, may also be used instead of hinges.

The lighting means 22 when activated casts light on the access code panel 24 and located on the side panel 30 of the first housing 10. As shown in FIG. 5 of the parent application and incorporated by reference herein, the lighting means 22 comprises a light bulb 50, a light bulb holder 52, a lens 54, batteries 58, and a contact spring 60 connected to a contact surface 62. The bulb 50 and lens 54 extend above the access code panel 24 wherein the bulb 50 is within the lens 54. The bulb 50 when lighted shines out through the lens 54 to light the access code panel 24.

In this embodiment, light is cast onto both the access panel 24 and into the interior of the second housing 12 in an open position. The construction of the lens 54 shines light to see the access code panel 24 and also to see any contents of the lockbox 8 when opened. The lens 54 may be of red tint so as not to initially blind the operator in total darkness. Furthermore, an upper light deflector 72 deflects light from shining directly into the operator's eyes.

The light is activated by the touch of the access code panel 24 with the hand or by activation of the actuator button 23 as previously discussed. Furthermore, the lighting means 22 may be recessed into the access code panel 24 to properly light the panel without being extended above the top panel 30 of the first housing 10.

The inside surface of the second housing 12 may be entirely fitted with a soft material 57, such as foam rubber contoured to the shape of a handgun. This material 57 may be glued or otherwise fastened within the second housing 12. This helps hold the handgun in a stable position within the lockbox 8, as well as to protect the handgun from scratches. Finally, a carrying handle 59 may be permanently or releaseably secured to the top panel 30 of the lockbox 8. As shown in FIG. 1, the handle 59 is releasably secured to two retainers 90 shown particularly in FIG. 3. The handle 59 may be recessed into the top panel 30 of the first housing 10.

As shown in FIG. 6, another embodiment of the invention uses a similar bracket 61 to fasten a lockbox 63 of slightly different configuration to a bed frame support shown in phantom line. When secured to the bed frame support, the lockbox 63 is located under the bed (not shown), as opposed to along side the bed. Only the access panel 24 and lighting means 57 is exposed from beneath the bed when in an assembled condition.

Similarly, the bracket 61 conforms to the shape of the bed frame support 7 which may have an "L-shape" as shown or have a larger bite 73 having a square shape in another configuration not shown. The lockbox 63 functions exactly like the other above-described embodiments, except that the hinge means 14 is replaced by a sliding roller means 65. Also, the shapes and sizes of the complementing first and second housings 10 and 12 are such that the second housing 12 can slideably move into and out of the first housing 10. The action is similar to a dresser drawer, except that the sliding roller means 65 is under tension from a spring means 67 to similarly cause the lockbox to have a "pop-open" action. Also, it should be noted that the lighting means 57 and access code panel 24 are located on a rectangular side 69 of the first housing 10 so as to be properly exposed when fastened to the bed frame support 7.

It should be appreciated from the foregoing description that the present invention provides an improved and portable gun lockbox, which also serves as a carrying case. It is simple in construction, yet completely effective in securing a loaded handgun, preventing it from being carried away, and allowing quick access to anyone with the proper code, even at night. Moreover, it can serve as an ordinary carrying case for a handgun when not locked to a bed frame support and subsequently and easily installed when traveling to serve its securing function.

Although the present invention has been described in detail with reference only to the presently preferred embodiments, it will be appreciated by those of ordinary skill in the art that various modifications may be made without departing from the essence of the invention and all such modifications are intended to be covered by the appended claims.

I claim:

1. A handgun lockbox to prohibit unauthorized access to a handgun and lock the lockbox to a stationary object, the lockbox comprising:

(a) a coupling means;

(b) a pair of complementary housings coupled together by said coupling means to form a compartment therebetween of sufficient size to hold the handgun and wherein said housings can be secured together to prevent the unauthorized access to the handgun, unless the housings are in an open position;

(c) a latch means for latching adjacent sides of said complementary housings to lock the complementary housings in alignment preventing unauthorized access to the said compartment therebetween;

(d) a bracket means for bracketing one of said housings to the stationary object, wherein said bracket means is of a predetermined length and geometric shape to fit around the stationary object and wherein said bracket means fixedly attaches to one of said housings holding the stationary object between said bracket means and said one of said housings when in an installed condition.

2. A handgun lockbox as claimed is claim 1, wherein said bracket means can be attachably detached from said one of said complementary housings when the lockbox is in said open position.

3. A handgun lockbox as claimed in claim 2, further comprising a lighting means for allowing actuation of said latch means in darkness.

4. A handgun lockbox as claimed in claim 3, wherein said complementing housings are of a shape and design such that the weight of the handgun on one of said housings causes said one of said housings to rotate about said coupling means opening the lockbox when said latch means is in an open position.

5. A lockbox as claimed in claim 4, wherein said light means is activated by a button which may selectively activate said latch means.

6. A handgun lockbox as claimed in claim 5, wherein said coupling means includes a spring means interconnected between said housings for causing said housings to open when said latch means is in an open position causing said lockbox to open to a predetermined degree.

7. A handgun lockbox as claimed in claim 6, wherein inside surfaces of said housings are lined with a soft material to protect the handgun.

8. A handgun lockbox as claimed in claim 7, further comprising at least one bolt and at least one complementing nut, wherein said nut may engage said bolt to hold said bracket to one of said housings therebetween when said lockbox is in the installed condition, and wherein said nut cannot be disengaged from said bolt by unauthorized personnel when the lockbox is in a closed condition.

9. A handgun lockbox as claimed in claim 3, wherein said bracket comprising a first and second end with a bite defined therebetween of a predetermined shape and size to engage a bed frame support having a predetermined shape.

10. A handgun lockbox of the like comprising the combination, a first and second readily transportable housing member securely coupled and defining therebetween a chamber sufficient in size and configuration to contain a gun or the like; bracketing means secured to one of said first and second housing member to releasably secure said lockbox to a stationary object and locking means operatively associated with said first and second housing member and adapted to prevent unauthorized access to said chamber, whereby said gun or the like is securely retained within said lockbox.

11. A lockbox as defined in claim 10, wherein said locking means includes a lighting means for allowing said locking means to be actuated in darkness, wherein said lighting means and said locking means are selectively activated by a button.

12. A lockbox as claimed in claim 11, wherein the said coupling means includes a spring means interconnected between said housing members for causing said members to pop apart when said locking means is unlocked causing said lockbox to open a predetermined degree.

13. A lockbox as claimed in claim 12, wherein said first and second housing members are of a shape and design such that the weight of the gun or the like on one of said members causes said one member to rotate about a coupling means opening said lockbox when said locking means is in an open position.

14. A lockbox as defined in claim 13, wherein inside surfaces of said housing members are lined with a soft material conformed to the shape of said gun or the like.

15. A handgun lockbox to prohibit unauthorized access to a handgun and selectively lock the lockbox to a stationary object, the lockbox comprising:

(a) a coupling means;

(b) a pair of complementary housings coupled together by said coupling means to form a compartment therebetween of sufficient size to hold the handgun and which can be secured together to prevent the unauthorized access to the handgun, unless the housings are in an open condition, and wherein said housings fit together so that one of said housings recesses within said other housing for greater securement of said compartment therebetween;

(c) a latch means for latching together said complementary housings, selectively locking adjacent sides of said housings together in alignment, preventing unauthorized access to said compartment therebetween, further comprising an access panel to actuate said latch means, wherein said panel is readily exposed when said lockbox is in an installed condition;

(d) a bracket means for bracketing one of said housings to the stationary object, wherein said bracket means is of a length and geometric shape to fit around the stationary object, and wherein said bracket means removeably attaches to one of said housings so as to hold the stationary object between said bracket means and said one of said housings when in an installed condition, and wherein said bracket means is held to said one of said housings by a means for fastening which selectively engages said one of said housings, wherein said means for fastening may selectively release said one of said housings when said lockbox is in an open position.

16. A handgun lockbox as claimed in claim 15, wherein said coupling means is a hinge, wherein said hinge includes a tension spring to cause said complementary housings to pop apart when said latch means is actuated by an authorized person creating an open condition, and wherein said fastening means comprising at least one bolt and one nut, wherein said one nut may engage said one bolt to hold said means to said one of said housings.

17. A handgun lockbox as claimed in claim 15, wherein said coupling means is a sliding means for allowing movement of one of said housings in and out of said other housing.

18. A handgun lockbox as claimed in claim 17, wherein said sliding means is under tension allowing said one of said housings to pop out of said other housing when said latch means is actuated allowing said lockbox to open.

19. A handgun lockbox as claimed in claim 18, further comprising a soft interior surface which complements the shape of the handgun to be held within, and wherein said bracket is shaped to engage a bed frame support.

20. A handgun lockbox as claimed in claim 15, further comprising a means for lighting said panel, wherein said lighting means is selectively actuated.

* * * * *